United States Patent [19]

Fair et al.

[11] 4,414,959

[45] Nov. 15, 1983

[54] SHELF FOR A RANGE

[75] Inventors: Rickey F. Fair, Sharpsville; John R. Wilcox, Farrell, both of Pa.

[73] Assignee: Top Shelf Company, Inc., Wesst Middlesex, Pa.

[21] Appl. No.: 333,644

[22] Filed: Dec. 23, 1981

[51] Int. Cl.[3] ..... F24C 15/16

[52] U.S. Cl. ..... 126/332; 126/333

[58] Field of Search ..... 126/332, 333, 337 R, 126/337 A, 37 R, 37 A, 37 B, 299 D, 299 R; 312/196, 223

[56] References Cited

U.S. PATENT DOCUMENTS

| | | | |
|---|---|---|---|
| 313,940 | 3/1885 | Kehoe | 126/333 |
| 514,919 | 2/1894 | Finch et al. | 126/36 |
| 1,001,383 | 8/1911 | Geer et al. | 126/332 |
| 2,050,532 | 8/1936 | Huenefeld | 126/37 A |
| 2,243,491 | 5/1941 | Whitenack | 126/299 D |
| 3,361,090 | 1/1968 | Howlett | 312/223 |

FOREIGN PATENT DOCUMENTS

| | | | |
|---|---|---|---|
| 187419 | 10/1922 | United Kingdom | 126/332 |

*Primary Examiner*—James C. Yeung

*Attorney, Agent, or Firm*—Stephen Ross Green

[57] ABSTRACT

This invention is directed to a device for holding an object such as a microwave oven above the burner area of a kitchen stove or range of the type commonly used in homes. The disclosed invention includes a platform for holding the object which is rigidly secured to a support. The support is adapted to engage the drip rails on both sides of the burner area of the range to hold the platform at a predetermined height above the burner area. A stiffening member is secured to the platform and to the support to provide rigidity to the shelf which stiffening member has a heat reflective surface extending substantially across the burner area of the range to reflect heat back toward the burner area and away from the shelf.

1 Claim, 2 Drawing Figures

SHELF FOR A RANGE

This invention relates to a shelf for a range.

More specifically, a device is disclosed for holding an object such as a microwave oven above the burner area of a kitchen stove or range of the type commonly used in homes. The disclosed invention includes a platform for holding the object which is rigidly secured to a support. The support is adapted to engage the drip rails on both sides of the burner area of the range to hold the platform at a predetermined height above the burner area. A stiffening member is secured to the platform and to the support to provide rigidity to the shelf, which stiffening member has a heat reflective surface extending substantially across the burner area of the range to reflect heat back toward the burner area and away from the shelf.

DESCRIPTION OF THE PRIOR ART

Numerous devices are commercially available at the present time which are able to support items commonly found in the kitchen such as microwave ovens, cooking utensils and the like, in a location convenient for use while cooking. The majority of these devices are in the form of a shelf which is rigidly attached to a wall behind the range. Alternatively, a survey of the market also discloses combination ranges and microwave ovens which are combined as an integral unit, and a review of prior art also uncovers a patent issued to J. Geer and A. C. Coty, U.S. Pat. No. 1,001,383. The Geer patent is a lightweight collapsible combination stove shelf and grease guard. It is disclosed as fabricated of sheet metal, hinged so as to be readily collapsible. The folding sides include catches which engage edges or flanges at the rear and sides of the stove. The function of that particular device is primarily to prevent grease from splattering on the wall behind the stove. Additionally, the shelf provided as a part of the device can support light objects such as cooking utensils. The structure disclosed in the Geer patent may be unusable with modern ranges or stoves since the controls of most ranges are generally located at the back of the burner area of the range and would prevent the rear catches of the Geer device to engage properly. In addition, because the Geer patent discloses sheet metal fabrication, it is unlikely to have sufficient rigidity to support a heavy object such as a microwave or convection oven, or even heavy cooking pots. Finally, the Geer invention must be assembled and engaged and the surfaces may become hot in use.

It is therefore an object of this invention to provide a shelf for a range which shelf has sufficient rigidity to support a heavy object such as a microwave oven in a convenient location above the burner area of a range.

A further object of the invention is to provide a rigid shelf for a range which is convenient to use and easy to engage and disengage from the range.

Yet another object of the invention is to provide a shelf for a range which will prevent heat radiating from the range from reaching the object placed upon the shelf.

Another object is to provide a shelf for use with a range which provides supporting capacity equal to a shelf which must be secured to a wall behind the range.

In attaining the foregoing objects, the invention provides a shelf for use with a stove or range, the stove or range being of the type which has a burner area and a drip rail on both sides of the burner area. A platform which is substantially planar is supported above the burner area of the range at a predetermined height by two supports. Each support is secured to its corresponding side of the platform, and extends downward to the burner area of the range, where each support is adapted to engage the drip rail on its corresponding side of the range. To add rigidity to the shelf, a structural stiffening member is included which is secured to each support and to the platform to prohibit relative movements among the platform and the two supports. In addition, the stiffening member has a shape such that it may be provided with a heat reflective surface which is able to reflect heat radiated by the range back toward the burner area and away from the objects on the shelf.

Other objects and advantages of the present invention will become apparent from the ensuing description of an illustrative embodiment thereof, in the course of which reference is made to the accompanying drawings in which:

FIG. 1 illustrates in three-dimensional form the preferred embodiment of the invention holding a microwave oven which is shown in phantom view; and FIG. 2 is a section of a portion of FIG. 1.

DESCRIPTION OF THE PREFERRED EMBODIMENT

Figure 1:
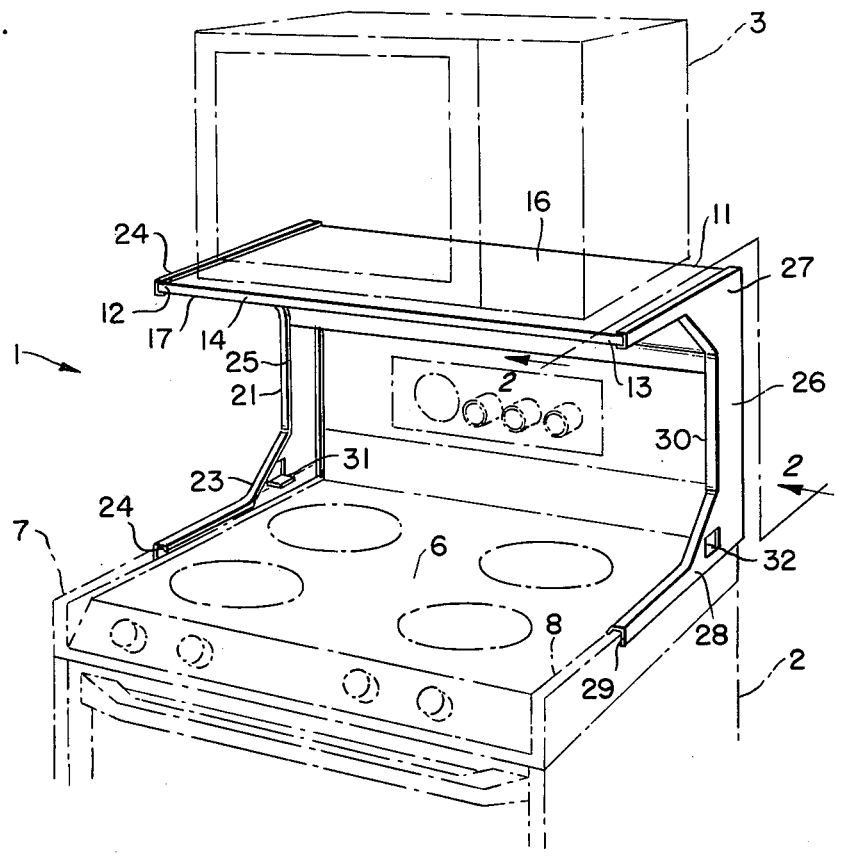
Figure 2:
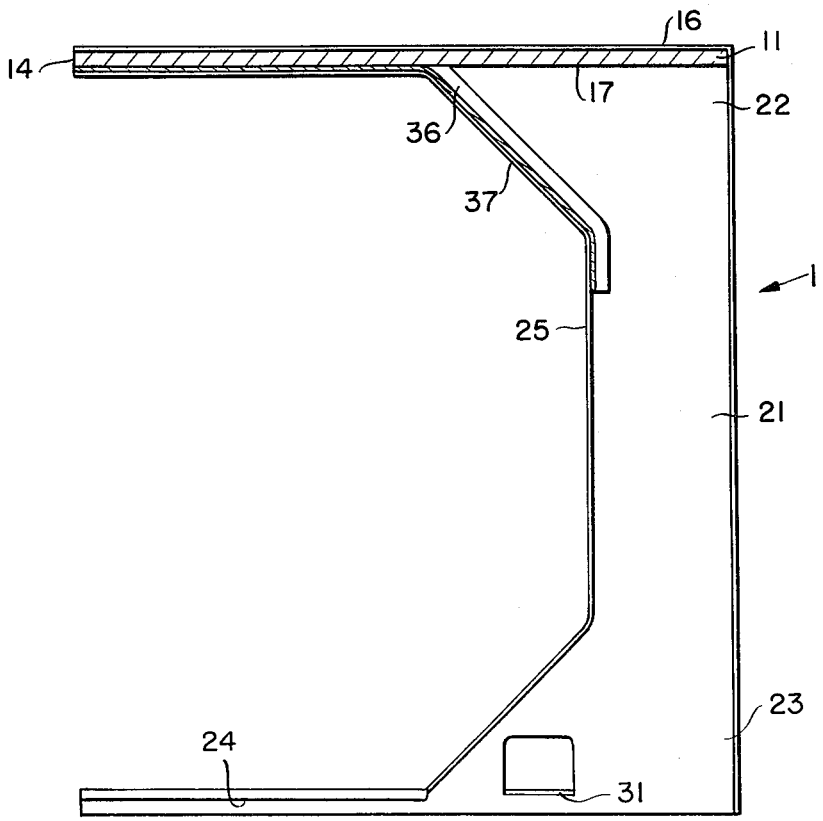

A clearer understanding of the invention will be obtained if FIG. 1 and FIG. 2 are studied in conjunction with the description as follows:

Referring to FIG. 1, there is shown a shelf generally indicated by reference numeral 1 being used in conjunction with a range shown in phantom outline and indicated by reference numeral 2. Shelf 1 is shown in this instance supporting microwave oven 3, likewise shown in phantom outline. Of course, it should be understood that shelf 1 can support any variety of other objects or devices. Range 2 is provided with burner area 6 where most normal cooking is done. At either side of range 2 are first drip rail 7 and second drip rail 8. First drip rail 7 and second drip rail 8 are common features in most ranges presently in use, and prevent liquids spilled during cooking from dripping from range 2. The distance between first drip rail 7 and second drip rail 8 is somewhat standard among manufactures of ranges.

Referring at this point to FIG. 2 in conjunction with FIG. 1, shelf 1 is provided with platform 11 which is shown as being essentially flat. Platform 11 further has a first end 12 and a second end 13, and in use, these are oriented so as to be aligned adjacent to first drip rail 7 and second drip rail 8 respectively, of range 2. In addition, platform 11 has a front edge 14, and further, has top surface 16 and bottom surface 17, which are disclosed in the preferred embodiment as being substantially parallel to one another.

Still referring to FIG. 2 in conjunction with FIG. 1, platform 11 is supported at a predetermined height above burner area 6 of range 2 by first support 21 and second support 26, which are spaced apart by approximately the width of first drip rail 7 and second drip rail 8. First support 21 and second support 26 are shown as being formed from a sheet of material such as steel but other fabrications and constructions of first support 21 and second support 26 are possible. As may be seen in detail on FIG. 2, first support 21 is disclosed as having an upper portion 22, a lower portion 23 and an edge 25. Upper portion 22 of first support 21 is adapted to receive first end 12 of platform 11 and is rigidly secured to first end 12 of platform 11 by the use of screws, nails or adhesives. Lower portion 23 of first support 21 is formed into a first channel 24 which has a cross section congruent with and slightly larger than the cross section of first drip rail 7, hence is able to overlap and engage first drip rail 7 when channel 24 is placed upon first drip rail 7. In a similar manner, second support 26 has an upper portion 27, a lower portion 28 and an edge 30. Second support 26 is secured to second end 13 of platform 11 in the manner described above relative to first support 21, lower portion 28 of second support 26 being likewise formed into a second channel 29 for overlapping and engaging second drip rail 8. The distance between first channel 24 and second channel 29 is the same as that between first drip rail 7 and second drip rail 8. Although first channel 24 and second channel 29 are shown and described as being an integral part of lower portion 23 of first support 21 and lower portion 28 of second support 22 it should be apparent that first channel 24 and second channel 29 may be separately fabricated and secured to lower portion 23 and lower portion 28.

Since first channel 24 of first support 21 and second channel 29 of second support 26 engage first drip rail 7 and second drip rail 8, respectively for only a limited distance along first drip rail 7 and second drip rail 8, lower portion 23 of first support 21 and lower portion 28 of second support 26 are provided with first tab 31 and second tab 32 respectively which are located at a distance from first channel 24 and second channel 29 along lower portion 23 and lower portion 28. First tab 31 bears against a portion of first drip rail 7 not engaged with first channel 24, and in a similar manner, second tab 32 bears against a portion of second drip rail 8 not engaged with second channel 29 to prevent shelf 1 from rocking on range 2 and to otherwise prevent instability of shelf 1 on range 2 in the event that the load placed upon shelf 2 is off center. First tab 31 and second tab 32 are shown as being stamped from the material out of which first support 21 and second support 26 are made, but it should be apparent that first tab 31 and second tab 32 may be separately fabricated and secured to first support 21 and second support 26 by any commercially available method.

Referring now to FIG. 2, a stiffening member 36 extends from front edge 14 of platform 11 along a portion of bottom surface 17 of platform 11. As previously indicated, first support 21 and second support 26 are disclosed as having edges 25 and 30 respectively which extend toward burner area 6 of range 2, and stiffening member 36 is also secured to edge 25 of first support 21 and edge 30 of second support 26. Stiffening member 36 is additionally provided with heat reflective surface 37 which is integral with stiffening member 36 and is oriented substantially so as to reflect toward burner area 6.

OPERATION

Operation and use of the device first requires orienting shelf 1 such that first channel 24 of first support 21 and second channel 29 of second support 26 are in proximity with first drip rail 7 and second drip rail 8 respectively of range 2. Shelf 1 may then be placed upon range 2 whereupon first channel 24 of first support 21 and second channel 29 of second support 26 will overlap and engage respectively first drip rail 7 and second drip rail 8. In addition, first tab 31 will bear against first drip rail 7 and second tab 32 will bear against second drip rail 8 adding further stability to shelf 1. At this point, shelf 1 is removably secured to range 2 and an object such as a microwave or convection oven or heavy cooking pot may be placed on shelf 1, and will be firmly supported above burner area 6 of range 2, for convenient use during the cooking process.

Based on the foregoing description, it may be seen that the present invention provides a shelf for use on a stove or range, which shelf has sufficient rigidity to support a heavy object such as a microwave oven in a convenient location above the burner area of the range. Further, the shelf is convenient to use and place upon the range and is easy to engage and disengage from the range. Finally, the shelf provides for the radiating of heat from the range away from the objects or devices placed upon it, and the shelf will be found to be comparable in rigidity and strength to shelves now available which are secured to walls behind the range.

Although but one embodiment of the present invention has been illustrated and described, it will be apparent to those skilled in the art that various changes and modifications may be made therein without departing from the spirit of the invention, and the invention is only limited as set forth in the following claims:

We claim:

1. A shelf for use with a range, said range having a burner area which includes a first drip rail and a second drip rail at opposite sides thereof, said shelf comprising:

(a) a platform having a first end and a second end and further having a front edge, a top surface and a bottom surface;

(b) a first support having an upper portion and a lower portion, said upper portion of said first support being secured to said first end of said platform such that said platform is substantially parallel to said burner area, said lower poriton of said first support having integrally formed therewith a first channel receptive to engaging said first drip rail of said range;

(c) a second support having an upper portion and a lower portion, said upper portion of said second support being secured to said second end of said platform such that said platform is substantially parallel to said burner area, said lower portion of said second support having integrally formed therewith a second channel receptive to engaging said second drip rail of said range;

(d) a stiffening member having a heat reflective surface, said stiffening member being secured to said bottom surface of said platform in proximity to said front edge thereof, said stiffening member being secured also to said first support and to said second support such that said heat reflective surface of said stiffening member is oriented toward said burner area of said range;

(e) a first tab integral with said lower portion of said first support and spaced apart from said first channel, said first tab being able to bear against said first drip rail; and (f) a second tab integral with said lower portion of said second support and spaced apart from said second channel, said second tab being able to bear against said second drip rail.

* * * * *